United States Patent [19]

Bubar

[11] 4,056,752

[45] Nov. 1, 1977

[54] CERAMIC LAMP HAVING TUBULAR INLEAD CONTAINING YTTRIUM-ZIRCONIUM MIXTURE

[75] Inventor: Stanley F. Bubar, Chagrin Falls, Ohio

[73] Assignee: General Electric Company, Schenectady, N.Y.

[21] Appl. No.: 701,553

[22] Filed: July 1, 1976

[51] Int. Cl.[2] ..... H01J 61/06; H01J 61/36

[52] U.S. Cl. ..... 313/217; 313/220; 313/331

[58] Field of Search ..... 313/217, 220, 331, 332, 313/174, 178

[56] References Cited

U.S. PATENT DOCUMENTS

| | | | |
|---|---|---|---|
| 3,485,343 | 12/1969 | Jorgensen | 313/178 X |
| 3,558,963 | 1/1971 | Hanneman et al. | 313/178 X |

*Primary Examiner*—Rudolph V. Rolinec
*Assistant Examiner*—Darwin R. Hostetter
*Attorney, Agent, or Firm*—Ernest W. Legree; Lawrence R. Kempton; Frank L. Neuhauser

[57] ABSTRACT

A high pressure sodium vapor lamp arc tube of alumina ceramic has end closures one of which includes an externally projecting tube of niobium or tantalum serving as inlead and having a portion extending into the inside of the arc tube. A tungsten electrode shank is welded into the end of the niobium tube but the seal at the weld may not be fully hermetic. To assure a fully hermetic seal, a mixture of yttrium and zirconium which has a lower melting point than pure yttrium is included in the niobium tube.

5 Claims, 1 Drawing Figure

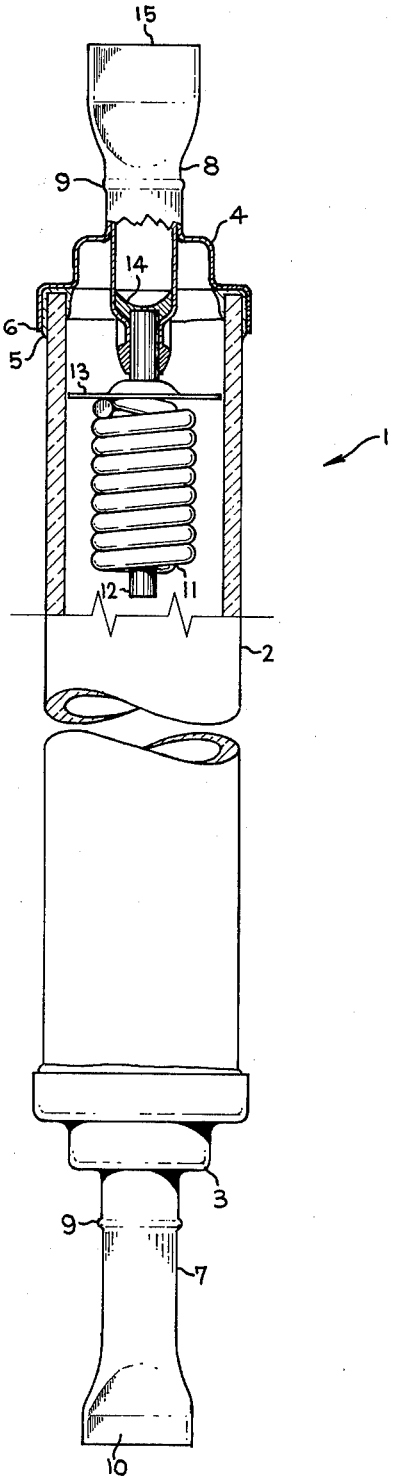
15
8
9
4
14
6
5
13
1
12
11
2
3
9
7
10

CERAMIC LAMP HAVING TUBULAR INLEAD CONTAINING YTTRIUM-ZIRCONIUM MIXTURE

The invention relates to metal vapor lamps comprising a sealed ceramic envelope, and is more particularly concerned with achieving a hermetic seal at the weld of a tungsten electrode shank to the end of a tubular niobium or tantalum inlead.

The invention is most useful with high intensity sodium vapor lamps of the basic type described in U.S. Pat. No. 3,248,590 — Schmidt, 1966, "High Pressure Sodium Vapor Lamp," and generally comprising an outer vitreous envelope or jacket of glass within which is mounted a slender tubular ceramic arc tube. The ceramic envelope is made of a light-transmissive refractory oxide material resistant to sodium at high temperatures, suitably high density polycrystalline alumina or synthetic sapphire. The filling comprises sodium along with a rare gas to facilitate starting, and mercury for improved efficiency. The ends of the alumina tube are sealed by suitable closure members affording connection to thermionic electrodes which may comprise a tungsten coil structure activated by electron emissive material. The outer envelope which encloses the ceramic arc tube is generally provided at one end with the usual screw base. The electrodes of the arc tube are connected to the terminals of the base, that is to shell and center contact, and the inter-envelope space is usually evacuated in order to conserve heat.

One well-known construction of ceramic arc tube utilizes tubular inleads of niobium having portions extending into the inside of the arc whose ends are crimped and welded about the tungsten shanks of the electrodes which they support. Where one niobium tube is used as an exhaust tube, it has an opening into the interior of the lamp envelope and is hermetically tipped and sealed off after the lamp has received its filling. The other niobium tube sometimes known as the dummy exhaust tube, has no such opening so that as a cost saving measure it is not evacuated nor hermetically sealed off at the outer end. However, it has been observed that the life of lamps so made is occasionally excessively short and the short life is attributed to very slow loss of filling. Leakage may take place through microscopic pores at the weld of the tungsten shank to the niobium dummy tube, or through longitudinally extending microscopic cracks or fissures within the tungsten shank proper.

It has been the practice to enclose within the dummy exhaust tube a small quantity of high purity yttrium. One function of the yttrium is to prevent sodium cleanup within the arc tube in accordance with the teachings of U.S. Pat. No. 3,558,963 — Hanneman et al., 1971, "High Intensity Vapor Arc Lamp." The yttrium does this, even though physically separated from the inner arc tube volume, because the niobium acts as a semipermeable membrane which allows residual oxygen traces to permeate through and react with the yttrium. The oxygen being thus removed from inside the arc tube cannot react with sodium and alumina to form sodium aluminate.

Another function of the yttrium is to assure a hermetic seal notwithstanding porosity of the tungsten electrode shank or of the surrounding weld to the inner end of the dummy niobium exhaust tube. During the operation of heat sealing the end cap to the end of the alumina tube, the yttrium melts and seals up the end of the tungsten shank and the weld region. However this technique has some drawbacks. The melting point of yttrium is 1509° C and this is within the acceptable sealing range for the arc tube seals which is from 1500° to 1530° C. But since high purity yttrium is processed in tantalum crucibles, one is apt to find in it residual tantalum contamination which will raise the melting point to 1520° C or even higher. Thus to insure ytrrium melting, the sealing operation must be carried out at the high end of the allowable sealing range, risking arc tube cracking due to excessively high temperatures. Also the high purity fine yttrium powder required commands a premium price and it has been found in practice that approximately 30% of the yttrium received from the supplier has a particle size too large for use in the process.

SUMMARY OF THE INVENTION

The object of the invention is to provide an acceptable lower cost substitute for the high purity fine particle size yttrium powder which has been used up to now. A difficulty which had to be overcome in finding a suitable material is that it must melt in the right temperature range without excessive attack of the niobium. For instance nickel melts in the right temperature range but rapidly dissolves niobium and so cannot be used.

My invention substitutes for high purity yttrium an alloy of yttrium and zirconium. The Y-Zr system has a simple eutectic point with a minimum melting temperature of 1360° C at 41% Zr by weight. If yttrium is alloyed with 50% zirconium its melting temperature is depressed from 1509° C to the range of 1360°–1380° C. Thus melting is assured throughout the sealing temperature range of the arc tube without excessive attack on the niobium tube. The strong melting temperature depressant effect of the zirconium overrides the effect of minor impurities in the yttrium giving consistent melting at a lower temperature, and allowing the use of a less pure and therefore less expensive grade of yttrium for the purpose.

DESCRIPTION OF DRAWING

The single FIGURE of the drawing shows an alumina ceramic arc tube in which the yttrium-zirconium alloy of the invention is used.

DESCRIPTION OF PREFERRED EMBODIMENT

The invention may be embodied in the arc tube of a high intensity sodium vapor discharge lamp comprising a vitreous outer jacket provided with a base at one end such as illustrated in previously mentioned U.S. Pat. No. 3,558,963 — Hanneman et al. Only the inner discharge envelope or arc tube 1 is illustrated in the drawing herein; a central portion of the tube has been cut out to shorten the figure and the internal construction is seen in the sectioned upper portion. It comprises an envelope 2 of ceramic tubing consisting of sintered high density polycrystalline alumina or alternatively of synthetic sapphire. The ends of the ceramic tube are closed by thimble-like niobium closures or end caps 3, 4 hermetically sealed to the ceramic by means of a sealing composition comprising primarily alumina and calcia. One suitable sealing composition is described and claimed in U.S. Pat No. 3,588,577 — McVey et al., 1971, "Calcia Alumina Magnesia Baria Seal Composition." The sealing composition is indicated at 5 located within the space between the expanded shoulder portion 6 of the end cap and the side end of the ceramic tube.

Niobium tubes 7, 8 penetrate into the thimbles 3, 4 and are hermetically welded to the thimble necks 9. The lower tube 7 is an exhaust tube and has an aperture (not shown) communicating with the interior of the envelope. After the filling comprising the sodium-mercury amalgam and the inert starting gas such as xenon is introduced into the envelope, the exhaust tube is hermetically pinched shut at 10.

Dummy exhaust tube 8 at the upper end does not have an opening into the interior of the envelope. It serves as inlead conductor to and support for electrode 11 comprising tungsten wire coiled on a tungsten shank 12; an activator such as barium calcium tungstate may be contained in the interstices between coil turns. A metal disk 13 serving as a shield to prevent back-arcing may be mounted on the shank 12. The shank is inserted into the crimped end of niobium tube 8 and the joint is then welded by the tungsten inert gas technique (TIG welding). In the welding, occasional porosity results in defective seals. Also the fibrous nature of the tungsten tends to include long narrow voids or streamers produced in the wire drawing process which may be responsible for very slow leakage. The seal of tungsten shank to niobium tube may be referred to as quasi-hermetic. The Y-Zr system has a eutectic point at 41% Zr with a minimum melting temperature of 1360° C at 41% Zr. If yttrium is alloyed with about 50% zirconium, its melting point is depressed from about 1509° C to the 1360°–1380° C range. This melting range is low enough that it is no longer a consideration in the sealing operation. Also the strong melting temperature depressant effect of the zirconium overrides the effect of minor impurities in the yttrium giving consistent melting at a lower temperature and allowing the use of a less pure and therefore less expensive grade of yttrium.

In the practice of the invention, the alloy is produced by mixing equal parts by weight of 40 mesh or finer Y powder and of 325 mesh ZrH powder and placing a charge thereof, indicated at 14, in the dummy exhaust tube. A typical charge would be from 20 to 40 milligrams of the mix. The tip of the niobium tube is now mechanically pinched shut at 15 in order to capture the charge in the cavity and prevent it from falling out in subsequent handling. However no attempt is made to make a hermetic seal at the closure 15 of niobium tube 8.

End cap 4 is sealed to the alumina tube 2 by assembling the parts with a quantity of the previously mentioned sealing composition pressed into a sealing washer of appropriate size between them, and heating in a vacuum furnace, as described in the McVey patent. During such heating, the ZrH within niobium tube 8 decomposes to elemental zirconium and hydrogen gas, the latter being pumped off by the furnace vacuum system. The Y and Zr interdiffuse during heating until melting occurs forming a homogeneous liquid phase. Y and Nb are immiscible but Zr and Nb are not and some solution of zirconium into the niobium tube occurs but this has no deleterious consequences. The liquid phase penetrates the pores and seals up the tungsten shank end and the weld area. Since the liquid phase or melt has been produced in place, it may be described as a braze. During subsequent cooling, the melt forms a multiphase system of Zr-saturated Y, Y-saturated Zr, and an yttrium oxide phase. There is also a Y-rich phase, pale blue in color, along the melt-niobium interface and this latter phase was also present in the previously used high purity yttrium melts. Tantalum which is closely related to niobium in its physical and chemical characteristics may also be used in lieu of the niobium tube in the end seal structure, and the same benefits obtained through the use of the Y-Zr alloy of the invention.

The invention thus provides the same benefits as were formerly achieved by using high purity fine particle size yttrium, but with reduced shrinkage due to the lower sealing temperature, and at lower material cost. By way of example, the high purity fine particle size yttrium formerly used sold for $580.00 per pound and it is now replaced by a lower purity grade selling for $200.00 per pound of which less than half as much is used.

The proportion of zirconium added to the yttrium is not critical but should be at least enough to depress the melting temperature of the mixture appreciably below that of pure yttrium. If desired, the composition may be shifted down to 41% weight percent zirconium to gain the lowest melting temperature available with the Y-Zr system, but at some increase in cost due to the use of a higher proportion of yttrium, the more expensive constituent. A preferred and economical proportion which is simple to prepare is about equal parts by weight yttrium and zirconium as previously described.

What I claim as new and desire to secure by Letters Patent of the United States is:

1. An electric lamp arc tube comprising:

a light-transmitting ceramic envelope having end closures sealing its ends and containing a discharge-sustaining filling including a vaporizable metal, electrodes supported from said closures at opposite ends of said envelope, one of said closures including a tubular niobium or tantalum inlead having a portion extending into the interior of said envelope, the electrode supported by said one closure comprising an emitting portion mounted on a tungsten shank, said tungsten shank extending from the interiorly extending portion of said inlead and being quasi-hermetically fastened thereto, and a mixture of yttrium and zirconium within said inlead at the joint with said tungsten shank, said mixture having been melted in place to form a braze penetrating any pores at the joint in order to assure a hermetic seal between said tungsten shank and said niobium inlead.

2. An arc tube as in claim 1 wherein the proportion of zirconium in the mixture is enough to depress the melting temperature of the mixture appreciably below that of pure yttrium and exceeds 20 percent by weight.

3. An electric lamp arc tube comprising:

an elongated light-transmitting alumina ceramic envelope having end closures sealing its ends and containing a filling of sodium-mercury amalgam and an inert starting gas, electrodes supported from said closures at opposite ends of said envelope, a discharge sustaining filling including a vaporizable metal within said envelope, one of said closures comprising a metal end cap having an externally projecting niobium or tantalum tube sealed therethrough with a portion extending into the interior of said envelope, the electrode supported by said one closure comprising an emitting portion mounted on a tungsten shank, said tungsten shank extending from the interiorly extending portion of said tube and the end of said tube being pinched and quasi-hermetically welded about said shank, and a mixture of yttrium and zirconium within said tube at the joint with said tungsten shank, said mixture having been melted in place to form a braze penetrating any pores at the joint in order to assure a hermetic seal between said tungsten shank and said tube.

4. An arc tube as in claim 3 wherein the externally projecting portion of said tube is mechanically closed but not hermetically sealed at its outer end.

5. An arc tube as in claim 3 wherein the proportion of zirconium in the mixture is enough to depress the melting temperature of the mixture appreciably below that of pure yttrium and exceeds 20 percent by weight.

* * * * *